US005979459A

United States Patent [19]

Schneider

[11] Patent Number: 5,979,459

[45] Date of Patent: Nov. 9, 1999

[54] VENTILATED FILTER CIGARETTE WITH A COAXIAL FILTER ELEMENT

[75] Inventor: Werner Schneider, Quickborn, Germany

[73] Assignee: Brown & Williamson Tobacco Corporation, Louisville, Ky.

[21] Appl. No.: 09/069,012

[22] Filed: Apr. 28, 1998

[30] Foreign Application Priority Data

Apr. 30, 1997 [DE] Germany ..... 197 18 296

[51] Int. Cl.[6] ..... A24D 3/04

[52] U.S. Cl. ..... 131/338; 131/336; 131/339

[58] Field of Search ..... 131/336, 338, 131/339, 344, 360

[56] References Cited

U.S. PATENT DOCUMENTS

| | | | |
|---|---|---|---|
| 5,012,829 | 5/1991 | Morris . | |
| 5,379,789 | 1/1995 | Schneider et al. | 131/360 |
| 5,388,596 | 2/1995 | Schneider et al. | 131/360 |
| 5,423,336 | 6/1995 | Mentzel . | |
| 5,439,011 | 8/1995 | Schneider | 131/360 |
| 5,549,125 | 8/1996 | White | 131/342 |
| 5,622,190 | 4/1997 | Arterbery et al. | 131/339 |

FOREIGN PATENT DOCUMENTS

| | | |
|---|---|---|
| 0321740 | 6/1989 | European Pat. Off. . |
| 0392112 | 10/1990 | European Pat. Off. . |
| 0474940 | 3/1992 | European Pat. Off. . |
| 0528186 | 2/1993 | European Pat. Off. . |
| 0558166 | 9/1993 | European Pat. Off. . |
| 0579410 | 1/1994 | European Pat. Off. . |
| 0630587 | 12/1994 | European Pat. Off. . |
| 31 22 193 | 1/1983 | Germany . |
| 42 05 658 | 8/1993 | Germany . |

*Primary Examiner*—Stanley S. Silverman
*Assistant Examiner*—Jacqueline A. Ruller
*Attorney, Agent, or Firm*—Middleton & Reutlinger; John F. Salazar; Charles G. Lamb

[57] ABSTRACT

The invention refers to a ventilated filter cigarette comprising a tobacco rod, a wrapper for the tobacco rod and a filter ventilated through ventilation openings, including a coaxial filter element, comprising a filter core, a wrapper for the filter core, a filter jacket and a wrapper for the filter jacket, in which the material specifications of the tobacco rod and the filter and the dimensions of their individual components are designed to allow the smoke to flow mainly through the filter core (upon open ventilation zone) and when covering the ventilation openings, the smoke of the cigarette flows to a major degree through the filter jacket of the coaxial filter element.

16 Claims, 1 Drawing Sheet

VENTILATED FILTER CIGARETTE WITH A COAXIAL FILTER ELEMENT

BACKGROUND OF THE INVENTION

I. Field of the Invention

The invention refers to a ventilated filter cigarette comprising a tobacco rod, a wrapper for the tobacco rod and a filter ventilated by ventilation openings, said filter comprising a coaxial filter element including a filter core, a wrapper for the filter core, a filter jacket and a wrapper for the filter jacket.

II. Description of the Prior Art

Ventilated filter cigarettes are prior art. These cigarettes include a ventilation zone in the filter through which air is aspired when drawing on the cigarette. The ventilation zone may be generated, for example, by perforation of the filter wrapper by laser beams but also in a number of other ways. Ventilation of the filter offers a facility for controlling taste and may contribute to modifying nicotine and condensate values for cigarettes.

When smoking with a closed ventilation zone, the smoke yield will clearly increase.

SUMMARY OF THE INVENTION

It is the object of the present invention to design a ventilated filter cigarette without the disadvantage referred to above. In particular, whilst smoking with a closed ventilation zone, the smoke yield should increase to a lesser degree.

This object is solved by a ventilated filter cigarette comprising a tobacco rod, a wrapper for the tobacco rod and a filter ventilated by ventilation openings, said filter comprising a coaxial filter element including a filter core, a wrapper for the filter core, a filter jacket and a wrapper for the filter jacket wherein the material specifications and the dimensions of the individual elements of the tobacco rod and the filter are designed to allow the smoke of the cigarette to flow mainly through the filter core whilst the ventilation zone is open and to a major degree through the filter jacket of the coaxial filter element when the ventilation openings are covered.

The advantage of a filter cigarette according to the invention lies in the fact that the smoke yield is clearly subject to less increase when smoking a cigarette with an enclosed ventilation zone versus ventilated filter cigarettes not being the subject matter of this invention. The design of the material specifications and dimensions of individual components of both the tobacco rod and the filter have the effect of a change-over valve. When the ventilation openings are open, smoke mainly enters through the filter core of the coaxial filter element whilst when the ventilation openings are covered the flow is automatically guided, with a major part of the cigarette smoke also flowing through the filter jacket. In a cigarette of the present invention, the condensate value is increased, for instance, when the ventilation openings are covered by only approximately half of the increase of conventional filter cigarettes.

There are a number of possibilities for designing the ventilated filter of a cigarette in accordance with the present invention. The filter may be a monofilter constituting of one single coaxial segment, but also a filter comprising several longitudinal segments of which at least one is a coaxial segment. The ventilation zone is on the coaxial segment.

In an embodiment of the cigarette according to the invention, the filter comprises two longitudinal segments, with the rod-sided filter segment being a standard filter segment and the adjacent segment on the mouth side being a coaxial filter segment.

In another embodiment of the present invention, the filter comprises three longitudinal segments, with the rod-sided filter element being a conventional standard filter segment, followed by a central filter segment comprising a chamber filled with a selectively filtering material, in turn followed by a coaxial filter segment. Provision of an additional segment, being a chamber comprising a selectively filtering material, allows advantageous adaptation of the smoke composition.

A fourth embodiment of the filter provides a filter comprising three longitudinal segments, with the rod-sided filter element being a first conventional standard filter segment, followed by a central filter segment, namely a coaxial filter element, in turn followed by a filter segment comprising a second conventional standard filter segment or a hollow mouthpiece.

All of the four filter designs described above make available the advantageous effects, as specified above, when covering the ventilation openings.

One embodiment of the filter cigarette of the present invention is characterised in that in the coaxial filter element the wrapper of the filter core is essentially impervious to air, preferably constituting of cellulose acetate or paper, with the diameter of the filter core being dimensioned to make the ratio between the core cross-section area and the cross-section area of the jacket clearly less than 1, with the ratio of the resistances to draw between the filter jacket and the filter core being larger than 0.5, preferably 0.8 to 1.5, the specific resistance to draw of the filter core being 0.3 to 0.75, preferably 0.5, the ratio between the distance of the ventilation zone from the mouth-sided end of the coaxial filter element and the length of the coaxial filter element being larger than 0.8, preferably 0.87 to 0.93 and the ventilation zone being on the coaxial filter element, with the condensate yield of the tobacco rod being less than 25 mg, preferably less than 20 mg and the resistance to draw of the tobacco rod being less than 60 mm water column, preferably less than 50 mm water column.

The diameter of the filter in ventilated filter cigarettes according to the present invention is between 7.7 and 8.0 mm.

According to an advantageous embodiment of a ventilated filter cigarette, based on the present invention, in which the rod-sided filter segment consists of cellulose acetate, this has a low single titer, preferably of 2.1 dpf and less and a resistance to draw of less than 60 mm water column, preferably 35 to 50 mm water column.

Another embodiment according to the invention of a ventilated filter cigarette, in which the mouth-sided filter segment consists of cellulose acetate, has a high single titers, preferably 8 dpf and a resistance to draw of less than 20 mm water column, preferably 10 mm water column.

This mouth-sided filter segment may also be a hollow mouthpiece.

The selection of filter types addressed above for a ventilated filter cigarette according to the invention has been listed again in the following table 1:

TABLE 1

| Type No. | Segment 1 | Segment 2 | Segment 3 |
|---|---|---|---|
| 1 | Standard filter | Coaxial filter | — |
| 2 | Coaxial filter | — | — |
| 3 | Standard filter | Chamber comprising a selectively filtering material | Coaxial filter |
| 4 | Standard filter | Coaxial filter | Standard filter |

(Numbering of segments from the tobacco side)

Other feasible types are combinations of types 2 and 3 with an additional standard segment on the mouth side or a hollow mouth piece. Other types may be a mouth or tobacco-sided standard segment of fibre filters including additives having a selective effect, such as activated charcoal or carbon filters. Standard segments may also be replaced by specially formed filter segments, such as SCS filters supplied by Filtrona.

The materials for the filter core and the filter jacket of the coaxial filter elements may comprise any prior art filter materials; preferably, however, cellulose acetate is used. Specific resistance to draw values are based on a resistance to draw measured at 17.5 ml/s per length unit times area unit.

The length of the coaxial filter element will also be determined by the maximum specified length of the total filter. Specification of this length may be derived for technical or other reasons, with ventilation openings being in an area which is at least 11 mm away from the mouth-side end and on the coaxial segment of the filter. Accordingly, the minimum length of the coaxial segment for types 1 and 3 is 12 mm. The materials for the tobacco rod are tobacco substances and/or other thermally degradable substances. The tobacco rod may be a standard or coaxial tobacco rod.

For examples for a low increase in smoke yield of cigarettes according to the invention with a covered ventilation zone versus conventional cigarettes, see table 2 below.

TABLE 2

Increase in condensate volume when covering the ventilation zone

| Condensate values according to ISO (PMWNF) | For conventional cigarettes | For cigarettes according to the invention |
|---|---|---|
| 10 mg | 2–3 mg | 1 mg |
| 7 mg | 3–4 mg | 1–2 mg |
| 5 mg | 4–6 mg | 2–3 mg |

This shows that in cigarettes according to the invention only half (or less) of the increase in condensate occurs versus conventional ventilated filter cigarettes.

Condensate readings have been stated as PMWNF (=particulate matter water nicotine-free =condensate).

BRIEF DESCRIPTION OF THE DRAWINGS

In addition, the invention is described by two embodiments, based on the enclosed drawings, where.

DESCRIPTION OF THE PREFERRED EMBODIMENTS

Figure 1:
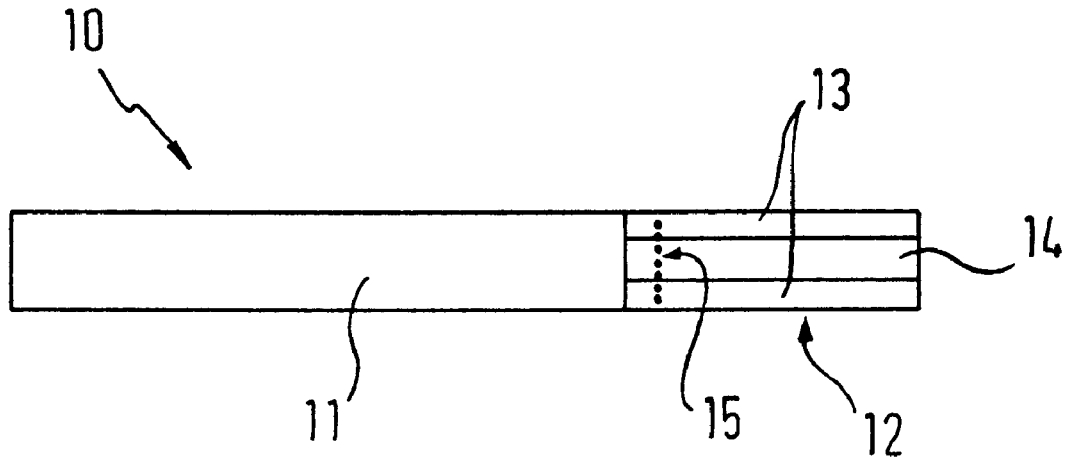
FIG. 1 is a diagrammatic sectional view of an embodiment of the ventilated filter cigarette according to the invention.

FIG. 1 shows a ventilated filter cigarette according to the invention in an embodiment comprising a coaxial monofilter. It is therefore a type 2 cigarette according to table 1. Filter cigarette 10 of FIG. 1 comprises a tobacco rod 11 to which a coaxial filter 12 is attached. The coaxial filter 12 comprises a filter core 14 and a filterjacket 13, with the wrapper of the filter core 14 being essentially impermeable to air. The dotted line shows ventilation openings 15, provided, for instance, by laser perforation.

The cigarette according to FIG. 1 has the following specification:

EXAMPLE 1

Tobacco Rod (11)

Condensate yield (PMWNF): 19 mg

Draw resistance of rod: 50 mm water column

Filter:

Type: coaxial monofilter (12)

Materials: cellulose acetate

Length: 27 mm

Position of ventilation zone (15): 25 mm from the mouth side

External diameter: 7.85 mm

Internal diameter: 3.4 mm

Resistance to draw of filter jacket (13): 140 mm water column

Single titer of filter jacket material (13): 3Y

Resistance to draw of filter core (14): 140 mm water column

Single titer of internal segment material of filter core (14): 8Y

Degree of ventilation: 50%

The condensate yield of the ventilated filter cigarette 10 is approx. 10 mg. When the ventilation zone 15 is covered, only a minor increase in condensate yield of up to 1 mg results.

Figure 2:
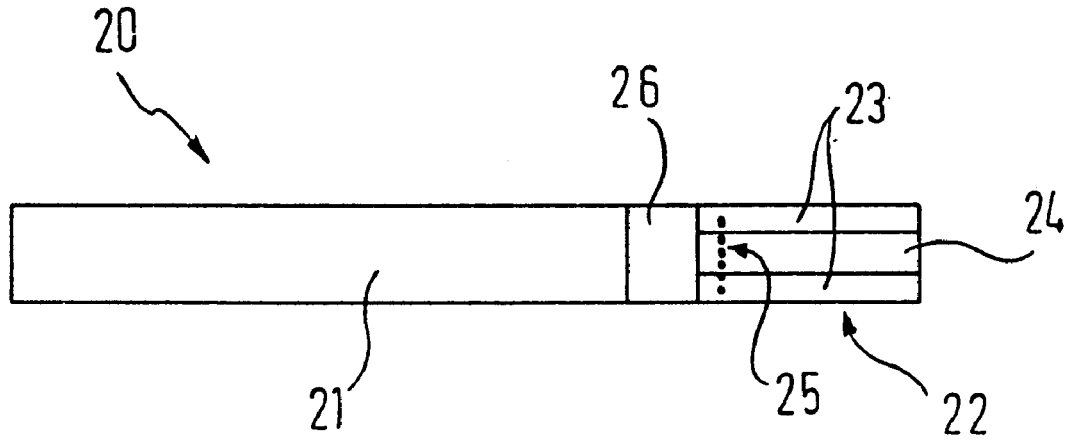
FIG. 2 is a diagrammatic section of another embodiment of the ventilated filter cigarette according to the invention.

FIG. 2 shows another embodiment of a filter cigarette ventilated according to the invention, comprising a filter with two longitudinal segments. This is a type 1 cigarette according to table 1.

The filter cigarette 20 comprises a tobacco rod 21 and a filter 22. The filter is divided in two sections over its length, constituting of a coaxial filter segment with a filter core 24 and a filter jacket 23 and a standard filter segment 26 between the coaxial filter segment 23, 24 and the tobacco rod 21. The ventilation openings 25 have been indicated close to the tobacco-sided end of the coaxial segment 23, 24 by a dotted line.

The cigarette according to FIG. 2 has the following specification:

EXAMPLE 2:

Tobacco Rod (20):

Condensate yield (PMWNF): 19 mm

Resistance to draw of rod: 45 mm water column

Filter (22):

Type: dual filter with a coaxial segment (23, 24) on the mouth side

Length: 27 mm

Material: cellulose acetate

Mouth-sided Element (23, 24):

Type: coaxial

Length: 21 mm

External diameter: 7.8 mm

Internal diameter: 3.4 mm

Position of ventilation zone (25): 19 mm from the mouth side end

Resistance to draw of filter jacket (23): 110 mm water column

Single titer of filter jacket material (23): 3Y

Resistance to daw of filter core (24): 110 mm water column

Single titer of material of filter core (24): 8Y

Degree of ventilation: 50%

Tobacco-sided segment (26):

Type: conventional

Length: 6 mm

Resistance to draw: 35 mm water column

Single titer: 2.1 Y

The condensate yield of the ventilated filter cigarette 20 is approx. 7 mg. When the ventilation zone 25 is covered, only a minor increase in condensate yield of up to 2 mg results.

I claim:

1. A ventilated filter cigarette comprising a) a tobacco rod b) a wrapper for the tobacco rod and c) a filter ventilated by ventilation openings, said filter comprising a coaxial filter element including a filter core, a wrapper for the filter core, a filter jacket circumscribing said core and a wrapper for the filter jacket, d) said wrapper for the filter core being impermeable and said ventilation openings extending through said jacket into said core whereby the material specifications and the dimensions of the individual elements of the tobacco rod and the filter are designed to allow the smoke of the cigarette to flow mainly through the filter core whilst the ventilation zone is open and to a major degree through the filter jacket of the coaxial filter element when the ventilation openings are covered.

2. A ventilated filter cigarette according to claim 1, wherein the filter comprises two longitudinal segments, with a rod-sided filter segment being a conventional standard filter segment and said ventilated segment being a coaxial filter segment adjacent said conventional filter on the mouth side of said cigarette.

3. A ventilated filter cigarette according to claim 1, wherein the filter comprises three longitudinal segments, with a rod-sided filter element being a conventional standard filter segment, said filter core adjacent to said rod-sided filter element being a chamber comprising a selectively filtering material and an adjacent filter segment being a coaxial filter element.

4. A ventilated filter cigarette according to claim 1, wherein the filter comprises three longitudinal segments, with a rod-sided filter element being a first conventional standard filter segment, said filter core adjacent to said rod-sided filter element being a coaxial filter element and an adjacent following filter segment being a second conventional standard filter element on the mouth side of said cigarette.

5. A ventilated filter cigarette according to claim 1, wherein the wrapper of the filter core is cellulose acetate or paper, the diameter of the filter core is so dimensioned that the ratio between the cross-sectional area of the core and the cross-sectional area of the jacket is substantially smaller than 1, the ratio between the resistances to draw of the filter jacket core is larger than 0.5, the specific resistance to draw of the filter core is 0.3 to 0.75, the ratio between the distance of the ventilation zone from the mouth-sided end of the coaxial filter element and the length of the coaxial filter element is larger than 0.8, and the ventilation zone is on the coaxial filter element and in the tobacco rod:

the condensate yield is less than 25 mg, and the resistance to draw is less than 60 mm water column.

6. A ventilated filter cigarette according to claim 5, wherein in the coaxial filter element the ratio between the resistances to draw of the filter-jacket and the filter core is 0.8 to 1.5.

7. A ventilated filter cigarette according to claim 5, wherein in the coaxial filter element the specific resistance to draw of the filter core is 0.5.

8. A ventilated filter cigarette according to claim 5, wherein in the coaxial filter element the ratio between the distance of the ventilation zone from the mouth-sided end of the coaxial filter element and the length of the coaxial filter element is 0.87 to 0.93.

9. A ventilated filter cigarette according to claim 5, wherein in the coaxial filter element the condensate yield is less than 20 mg.

10. A ventilated filter cigarette according to claim 5, wherein the diameter of the filter is between 7.7 and 8.0 mm.

11. A ventilated filter cigarette according to claim 2, wherein the rod-sided filter segment consists of cellulose acetate, having a low single titre, and a resistance to draw of less than 60 mm water column.

12. A ventilated filter cigarette according to claim 2, wherein the rod-sided filter segment consists of cellulose acetate, having a low single titre of 2.1 dpf or less and a resistance to draw of 35 to 50 mm water column.

13. A ventilated filter cigarette according to claim 4, wherein the mouth-sided filter segment consists of cellulose acetate, having a high individual titre and a resistance to draw of less than 20 mm water column.

14. A ventilated filter cigarette according to claim 13, wherein the mouth-sided filter segment consists of cellulose acetate, having a individual titre of about 8 dpf and a resistance to draw of about 10 mm water column.

15. A ventilated filter cigarette according to claim 4, wherein the mouth-sided filter segment is a hollow mouthpiece.

16. A ventilated filter cigarette according to claim 1, wherein the resistance to draw of the tobacco rod is less than 50 mm water column.

* * * * *